US008616844B2

(12) United States Patent
Farlow et al.

(10) Patent No.: US 8,616,844 B2
(45) Date of Patent: Dec. 31, 2013

(54) FAN AND SHROUD ASSEMBLY

(75) Inventors: Scott K. Farlow, Cedar Falls, IA (US); Christopher A. Bering, Dike, IA (US); Adam J. Shuttleworth, Denver, IA (US); Thomas F. Tock, Denver, IA (US)

(73) Assignee: Deere & Company, Moline, IL (US)

( * ) Notice: Subject to any disclaimer, the term of this patent is extended or adjusted under 35 U.S.C. 154(b) by 595 days.

(21) Appl. No.: 12/778,660

(22) Filed: May 12, 2010

(65) Prior Publication Data

US 2011/0280719 A1 Nov. 17, 2011

(51) Int. Cl.
*F04D 29/52* (2006.01)

(52) U.S. Cl.
USPC ..... 415/222; 415/220; 416/169 A; 416/189

(58) Field of Classification Search
USPC ..... 416/169 A, 189, 220 R, 220 A, 179, 243, 416/DIG. 2; 180/68.4
See application file for complete search history.

(56) References Cited

U.S. PATENT DOCUMENTS 2,355,619 A * 8/1944 Bossart ..... 165/122
3,937,189 A * 2/1976 Beck ..... 123/41.49
4,156,706 A * 5/1979 Bell et al. ..... 261/109
5,520,513 A * 5/1996 Kuroki et al. ..... 415/223
7,329,091 B2 2/2008 Yan et al.
7,481,619 B2 * 1/2009 Obosu et al. ..... 415/221
2002/0076327 A1 * 6/2002 Houten ..... 416/189

FOREIGN PATENT DOCUMENTS

DE 202011004708 9/2011
WO 2009130954 10/2009

OTHER PUBLICATIONS

German Search Report, recieved Mar. 18, 2012(5 pages).

* cited by examiner

*Primary Examiner* — Edward Look
*Assistant Examiner* — Aaron R Eastman

(57) ABSTRACT

An axial flow fan assembly includes a plurality of fan blades surrounded by a shroud. The shroud includes an annular first wall which extends radially outwardly, an annular second wall which extends axially and radially outwardly, and an annular third wall which joins the first wall to the second wall. The third wall has a curved cross sectional shape, and has a minimum diameter part which is positioned approximately half-way between the upstream and downstream edges of the fan blades. There is a desired relationship between the radius of curvature of the third wall and the diameter of the fan. There is a desired relationship between the height of the first wall and the diameter of the fan. The fan blades have an upstream edge which is upstream with respect to the first wall.

6 Claims, 2 Drawing Sheets

FAN AND SHROUD ASSEMBLY

FIELD OF THE INVENTION

The present invention relates to an axial flow fan and shroud assembly.

BACKGROUND OF THE INVENTION

Rotating engine mounted cooling fans are used to push air through the radiator of an engine cooling system. Normally, a fan shroud is mounted around such a fan. Typical pushing fan assemblies include a flat plate box shroud which is simple to manufacture and is common in low volume applications. Such a shroud design does not allow the design to match a shroud to a fan for a given application or maximize fan efficiency. It has been determined that for a pushing fan application with high static pressure, the relationship between the inlet shroud geometry and the fan is critical to fan performance. It desired to maximize the fan efficiency and air flow for a given fan speed and system restriction in such a fan/shroud assembly. In agriculture applications where fan diameters range from 550 millimeters to 1100 millimeters, ideal inlet conditions are not achievable in the space available. By designing a complex three dimensional fan shroud with specific inlet and outlet shapes, the efficiency of the fan/shroud/cooling system can be enhanced.

SUMMARY

Accordingly, an object of this invention is to provide an axial flow fan assembly with improved efficiency.

This and other objects are achieved by the present invention, wherein an axial flow fan assembly has a plurality of fan blades surrounded by an annular shroud. The shroud includes an annular first wall which extends radially outwardly at an upstream end of the assembly, an annular second wall which extends axially and radially outwardly at a downstream end of the assembly, and an annular third wall which extends between the first wall and the second wall. The third wall is outwardly concave and has a curved cross sectional shape and a minimum diameter part which is aligned with a radial plane which is positioned between the upstream and downstream edges of the fan blades. The third wall has a radius of curvature which is preferably less than 0.05 times the diameter of the fan blades. The first wall has a height in the radial direction which is preferably greater than 0.05 times the diameter of the fan blades. The second annular wall extends at an angle of preferably approximately 27 degrees with respect an axis of rotation of the fan. The fan blades have an upstream edge which is upstream with respect to the first wall

DESCRIPTION OF THE PREFERRED EMBODIMENT

Figure 1:
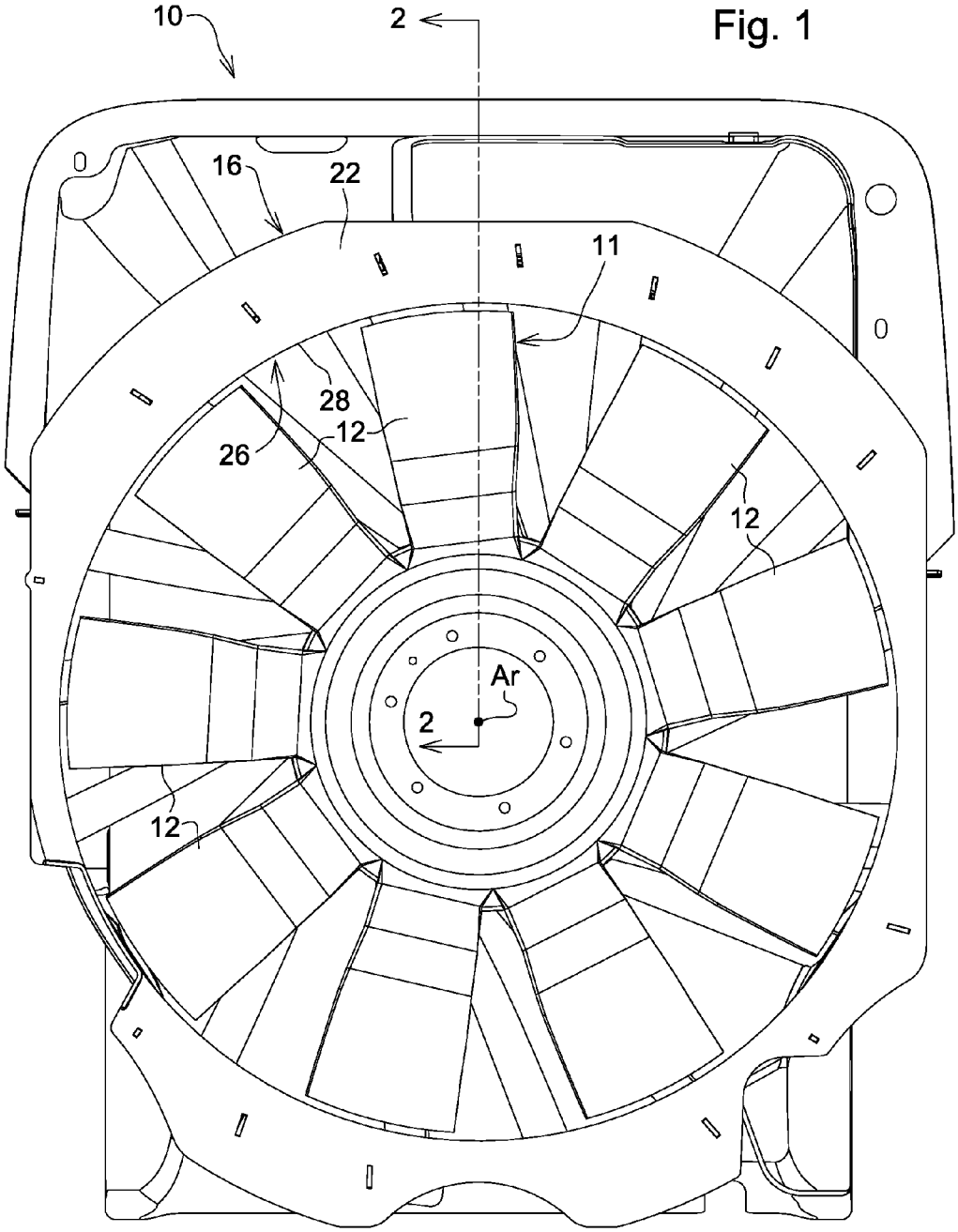
FIG. 1 is an partial end view of a fan assembly embodying the invention.
Figure 2:
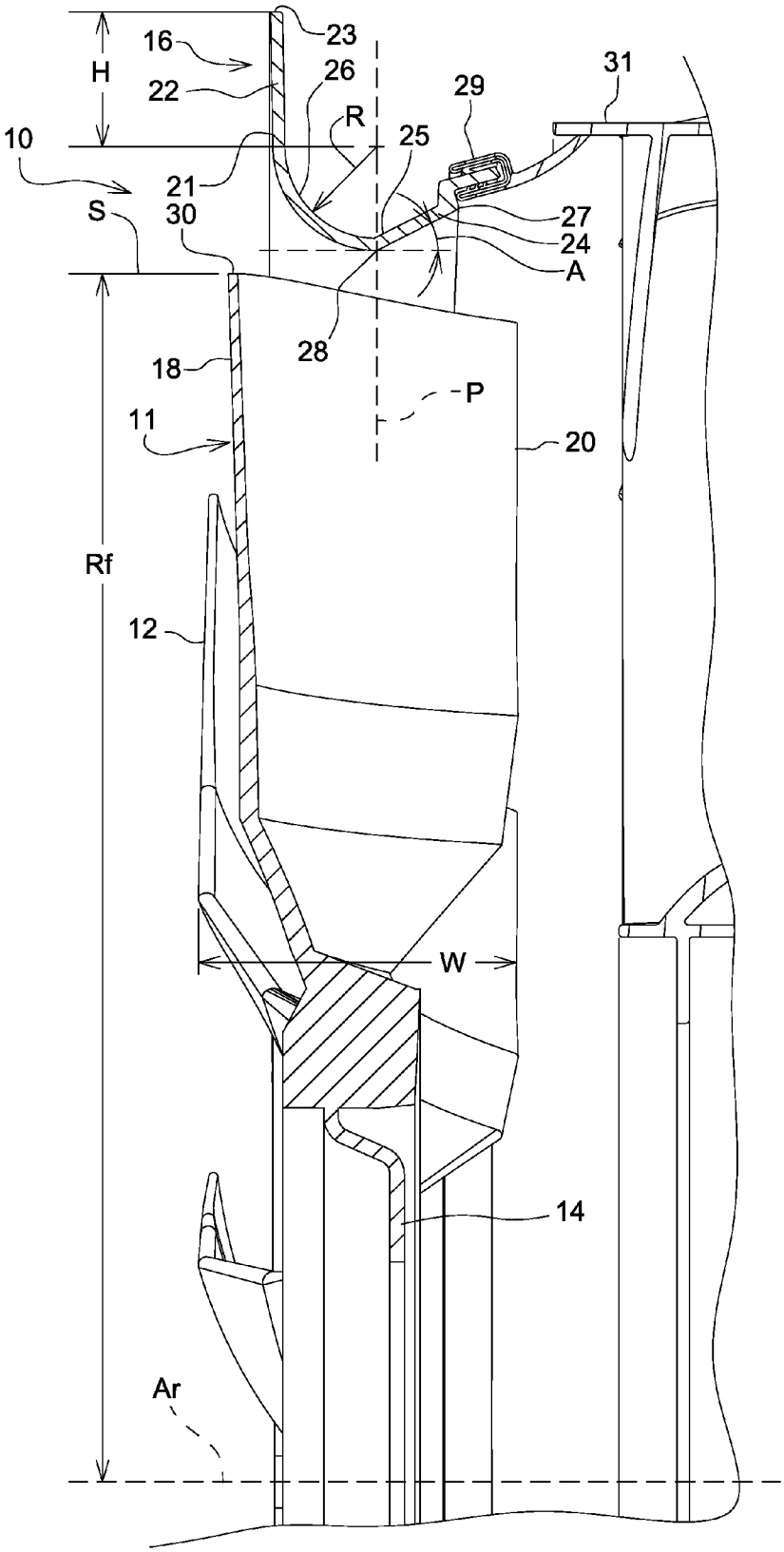
FIG. 2 is a view taken along lines 2-2 of FIG. 1.

An axial flow fan assembly 10 includes a fan 11 surrounded by a non-rotating annular shroud 16. The fan 11 has a plurality of fan blades 12 which extend outwardly from a central hub 14. Each fan blade 12 has an upstream edge 18 and a downstream edge 20 which define a projected axial width W when projected onto a plane (not shown) which contains the central rotation axis Ar. Each fan blade has a diameter D which is equal to twice the fan radius Rf measured from axis Ar to its outer edge 30.

The shroud 16 includes a first annular wall 22 which extends radially outwardly from an inner edge 21 to an outer edge 23 near an upstream end of the assembly. Wall 22 is fixed relative to the fan 11 and controls concentricity and immersion of the fan 11. The shroud 16 also includes a second annular wall 24 which extends axially and radially outwardly from an inner edge 25 to an outer edge 27 towards a downstream end of the assembly. The second wall 24 is downstream with respect to the first wall 22 in the air flow direction and includes a flexible seal joint 29. Wall 24 is supported by an annular housing 31 which is fixed to a vehicle chassis (not shown).

The shroud 16 also includes an annular third wall 26 which has a curved cross sectional shape, and which extends between the first wall 22 and the second wall 24. The third wall 26 is outwardly concave in cross-section, and has a minimum diameter part 28 which is aligned with a radial plane P which is positioned approximately half-way between the upstream and downstream edges 18, 20. The third wall 26 has a radius of curvature R which is preferably less than 0.05 times the blade diameter D. The first wall 22 preferably has a height H in the radial direction which is greater than 0.05 times the blade diameter D. The second wall 24 extends from the minimum diameter part 28 of the third wall 26. The second wall 24 preferably extends at an angle A with respect to a cylindrical surface S which is defined by the rotating our edges 30 of the blades 12, or with respect to a rotation axis of the fan. The angle A should be maximized until air flow separation occurs between the air exiting the fan blade 12 and the shroud 16.

Thus, starting at its upstream end, the shroud 16 forms a radially extending portion or first wall 22, a trumpet shaped portion or third wall 26, and an axially and radially outwardly extending frustoconical portion or second wall 24. Preferably, the shroud 16 has smooth transitions between the first wall 22 and the third wall 26, and between the third wall 26 and the second wall 24. The upstream edges 18 of the blades 12 are slightly upstream of the first wall 22.

Preferably, the height H of wall 22 should be greater than 0.05×D and the radius R should be less than 0.05×D. The fan immersion is preferably 0.5×the fan projected width W, but similar results were achieved in a range of 0.4×W to 0.6×W. Fan immersion is the axial amount of the fan relative to actual fan depth that the fan is surrounded by the shroud at the closest point radially.

The shape of the outlet 24 of the shroud 16 also affects the uniformity of the air and a quick expansion, referred to as the angle A of the shroud. It was also determined that for further optimal performance, the fan diameter must be smaller than the height and width of the heat exchanger cores (not shown) to allow room for the downstream end of the shroud to expand at angle A.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. An axial flow pusher fan assembly having a fan with a plurality of fan blades surrounded by a non-rotating annular shroud, each fan blade having an upstream edge defining an upstream plane and a downstream edge defining a downstream plane, and the fan having a diameter, wherein the shroud comprises:

an annular first wall which extends radially outwardly, the first wall being positioned between the upstream plane and the downstream plane;

an annular second wall which extends downstream axially and radially outwardly from an upstream end, the second wall being downstream with respect to the first wall in an air flow direction, and the second wall having a flexible seal joint; and an annular third wall which extends between the first wall and the second wall, the third wall having a curved cross sectional shape, the third wall having an upstream end which is connected directly to and forms a smooth transition with the first wall, and the third wall having a downstream end which is connected directly to and forms a smooth transition with the second wall.

2. The fan assembly of claim 1, wherein:

the second annular wall which extends at an angle of approximately 27 degrees with respect an axis of rotation of the fan.

3. The fan assembly of claim 1, wherein:

the second wall extends from a minimum diameter part of the third wall.

4. The fan assembly of claim 1, wherein:

the third wall is concave facing radially outwardly from an axis of the fan.

5. The fan assembly of claim 1, wherein:

the first wall has a height in the radial direction which is greater than 0.05 times the diameter of the fan.

6. An axial flow pusher fan assembly having a fan with a plurality of fan blades surrounded by a non-rotating annular shroud, each fan blade having an upstream edge defining an upstream plane and a downstream edge defining a downstream plane, and the fan having a diameter, wherein the shroud comprises:

an annular first wall which extends radially outwardly, the first wall being positioned between the upstream plane and the downstream plane;

an annular second wall which extends downstream axially and radially outwardly from an upstream end, the second wall being downstream with respect to the first wall in an air flow direction, and the second wall having a flexible seal joint, the first wall having a height in the radial direction which is greater than 0.05 times the diameter of the fan; and an annular third wall which extends between the first wall and the second wall, the third wall having a curved cross sectional shape, the third wall having an upstream end which is connected directly to and forms a smooth transition with the first wall, and the third wall having a downstream end which is connected directly to and forms a smooth transition with the second wall, the third wall having a radius of curvature which is preferably less than 0.05 times the fan diameter.

* * * * *